US009011184B2

(12) United States Patent
Chen et al.

(10) Patent No.: US 9,011,184 B2
(45) Date of Patent: Apr. 21, 2015

(54) POGO PIN CONNECTOR

(71) Applicant: Cheng Uei Precision Industry Co., Ltd., New Taipei (TW)

(72) Inventors: Yung Yi Chen, New Taipei (TW); Ming Chun Lai, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 120 days.

(21) Appl. No.: 13/975,237

(22) Filed: Aug. 23, 2013

(65) Prior Publication Data

US 2015/0056870 A1 Feb. 26, 2015

(51) Int. Cl.
*H01R 13/24* (2006.01)

(52) U.S. Cl.
CPC ..... *H01R 13/24* (2013.01)

(58) Field of Classification Search
CPC ..... H01R 13/2421; H01R 13/2428; H01R 11/18; H01R 2201/20; H01R 2103/00
USPC ..... 439/700, 482, 824, 658
See application file for complete search history.

(56) References Cited

U.S. PATENT DOCUMENTS

| | | | | |
|---|---|---|---|---|
| 6,935,906 | B2 * | 8/2005 | Orihara | 439/824 |
| 7,662,000 | B2 * | 2/2010 | Hou et al. | 439/824 |
| 7,815,474 | B1 * | 10/2010 | Lin et al. | 439/700 |
| 7,914,348 | B1 * | 3/2011 | Lin | 439/700 |
| 8,272,903 | B2 * | 9/2012 | Lin | 439/700 |
| 8,668,529 | B2 * | 3/2014 | Park et al. | 439/700 |

* cited by examiner

*Primary Examiner* — Hae Moon Hyeon
(74) *Attorney, Agent, or Firm* — Cheng-Ju Chiang

(57) ABSTRACT

A pogo pin connector includes an insulating housing, a plurality of pogo pins and contact terminals assembled forward in the insulating housing respectively. Front ends of the pogo pins retractably project beyond a front face of the insulating housing. A rear end of each of the pogo pins protrudes outward to form a riveted flange. Each of the contact terminals has a fastening plate placed levelly, an elastic contact arm curvedly extending upward from a front end of the fastening plate to elastically project beyond a top face of the insulating housing, and a fixing strip extending downward from a rear end of the fastening plate with a through hole being opened in a bottom end thereof. The rear ends of the pogo pins pass through the through holes of the contact terminals respectively to make the riveted flanges and the corresponding fixing strips riveted together.

5 Claims, 3 Drawing Sheets

POGO PIN CONNECTOR

BACKGROUND OF THE INVENTION

1. Field of the Invention

The present invention relates to an electrical connector, and more particularly to a pogo pin connector.

2. The Related Art

Conventionally, a pogo pin connector includes an insulating housing and a plurality of pogo pins assembled in the insulating housing. In use, the pogo pin connector is often soldered with a printed circuit board by reflow soldering. The reflow soldering is carried out by a series of operations such as high temperature. However, the process of utilizing the reflow soldering to solder the pogo pin connector with the printed circuit board easily brings about some adverse effects, such as deformation and bubble of the insulating housing, and could cause the loss of elasticity of the pogo pins after stress release of the reflow soldering. As a result, that reduces the service life of the pogo pin connector.

SUMMARY OF THE INVENTION

An object of the present invention is to provide a pogo pin connector including an insulating housing, a plurality of pogo pins and a plurality of contact terminals. The insulating housing defines a plurality of receiving passageways at a lower part thereof and a plurality of receiving grooves at a top thereof. The pogo pins are inserted forward in the receiving passageways of the insulating housing. Front ends of the pogo pins retractably project beyond a front face of the insulating housing. A rear end of each of the pogo pins protrudes outward to form a riveted flange. The contact terminals are assembled forward in the receiving grooves of the insulating housing. Each of the contact terminals has a fastening plate placed levelly, an elastic contact arm curvedly extending upward from a front end of the fastening plate to elastically project beyond a top face of the insulating housing, and a fixing strip extending downward from a rear end of the fastening plate with a through hole being opened in a bottom end thereof. The rear ends of the pogo pins pass through the through holes of the contact terminals respectively to make the riveted flanges and the corresponding fixing strips riveted together.

As described above, the pogo pins and the corresponding contact terminals are connected with each other by riveting the riveted flanges and the fixing strips together. In use, the pogo pin connector utilizes the elastic contact arms of the contact terminals to elastically press against a printed circuit board so as to realize electrical connection between the pogo pin connector and the printed circuit board. So that omits the reflow soldering in the prior art and effectively avoids deformation and bubble of the insulating housing and the loss of elasticity of the pogo pins. It improves the service life of the pogo pin connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
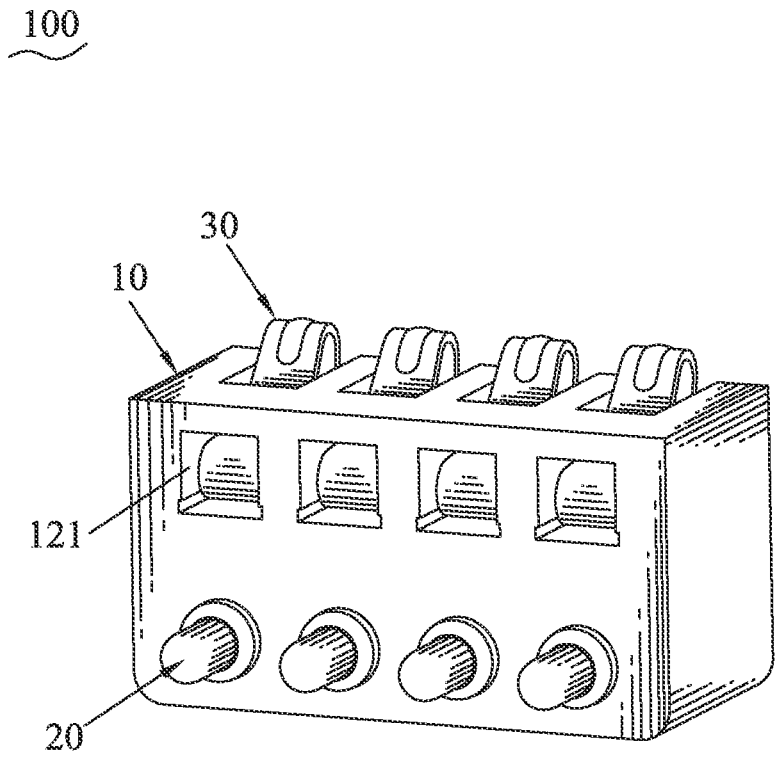
FIG. 1 is an assembled perspective view of a pogo pin connector in accordance with an embodiment of the present invention.
Figure 2:
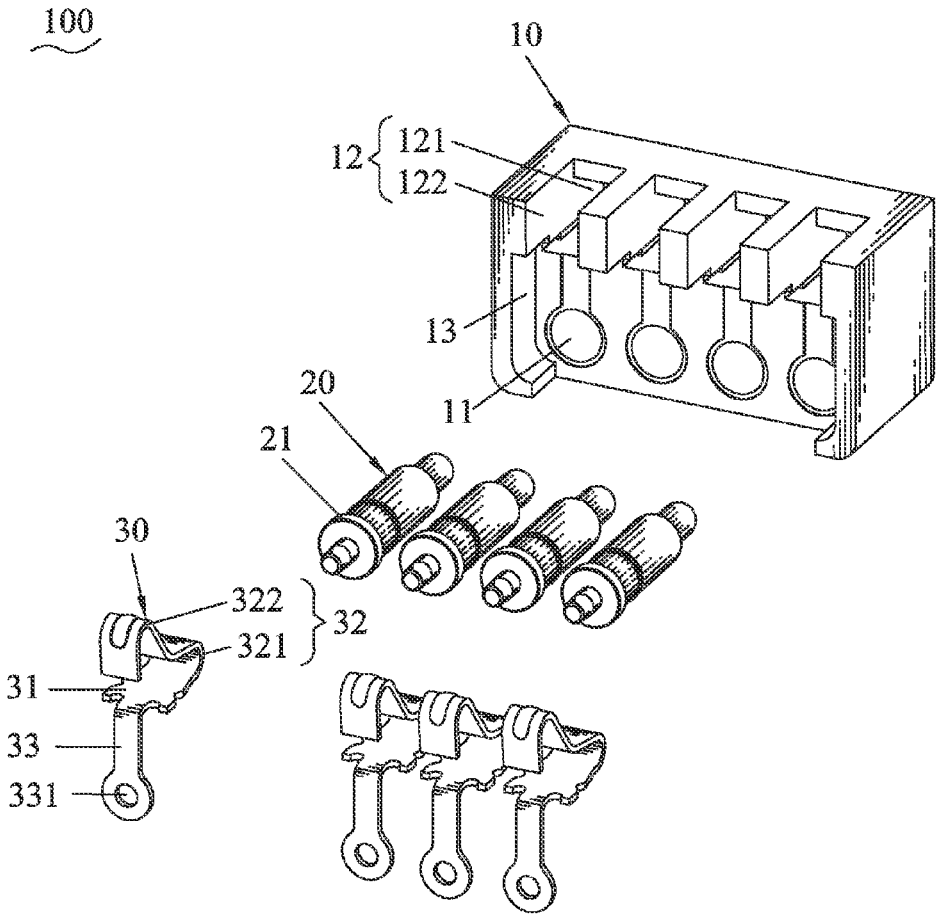
FIG. 2 is an exploded perspective view of the pogo pin connector shown in FIG. 1.
Figure 3:
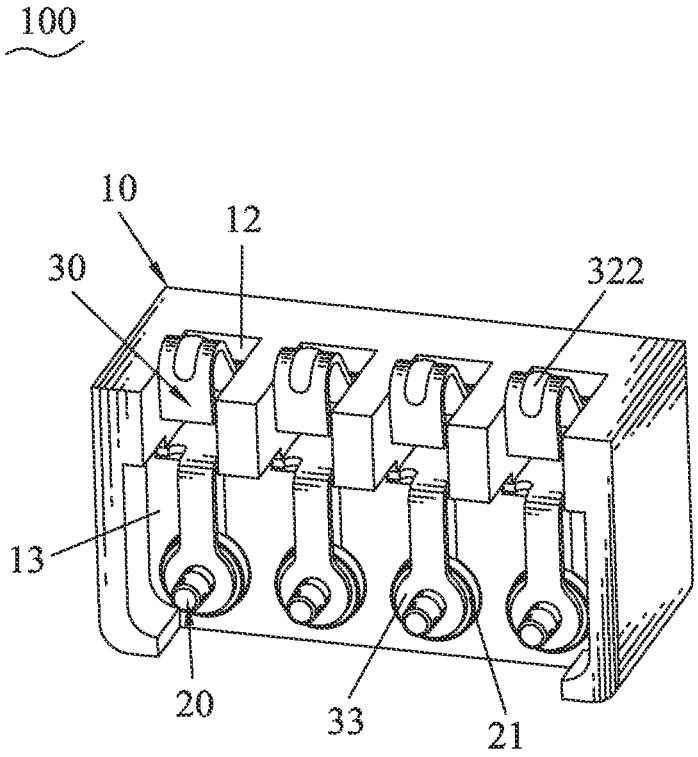
FIG. 3 is another assembled perspective view of the pogo pin connector shown in FIG. 1.

Referring to FIG. 1, FIG. 2 and FIG. 3, a pogo pin connector 100 according to an embodiment of the present invention includes an insulating housing 10, a plurality of pogo pins 20 and a plurality of contact terminals 30 assembled in the insulating housing 10 respectively.

The insulating housing 10 defines a plurality of receiving passageways 11 at a lower part thereof and a plurality of receiving grooves 12 at a top thereof. The pogo pins 20 are inserted forward in the receiving passageways 11 of the insulating housing 10. Front ends of the pogo pins 20 retractably project beyond a front face of the insulating housing 10. A rear end of each of the pogo pins 20 protrudes outward to form a riveted flange 21. The contact terminals 30 are assembled forward in the receiving grooves 12 of the insulating housing 10. Each of the contact terminals 30 has a fastening plate 31 placed levelly, an elastic contact arm 32 curvedly extending upward from a front end of the fastening plate 31 to elastically project beyond a top face of the insulating housing 10, and a fixing strip 33 extending downward from a rear end of the fastening plate 31 with a through hole 331 being opened in a bottom end thereof. The rear ends of the pogo pins 20 pass through the through holes 331 of the contact terminals 30 respectively to make the riveted flanges 21 and the corresponding fixing strips 33 riveted together.

The elastic contact arm 32 of the contact terminal 30 includes an elastic arm 321 curved arcuately upward and then extending rearward from the front end of the fastening plate 31, and a contact portion 322 slantwise extending upward and then bent downward from a free end of the elastic arm 321. The peak part of the contact portion 322 projects upward beyond the top face of the insulating housing 10. In this embodiment, the riveted flange 21 of the pogo pin 20 is of ring shape and protruded round the rear end of the pogo pin 20.

The receiving passageways 11 are arranged at regular intervals along a transverse direction of the insulating housing 10 and each penetrates through the insulating housing 10 along a front-to-rear direction. The receiving grooves 12 are arranged at regular intervals along the transverse direction of the insulating housing 10 and located over the receiving passageways 11 at a one-to-one correspondence relationship. Each of the receiving grooves 12 includes a holding groove 121 penetrating through an upper part of the insulating housing 10 along a front-to-rear direction and an opening 122 formed by a rear of the holding groove 121 extending upward to penetrate through the top of the insulating housing 10. The fastening plate 31 of the contact terminal 30 is fastened in a bottom side of the holding groove 121, the elastic arm 321 is inserted in the holding groove 121 and the peak part of the contact portion 322 passes upward through the opening 122.

Referring to FIG. 2 and FIG. 3 again, a rear face of the insulating housing 10 is concaved forward to form a receiving cavity 13. The rear ends and the riveted flanges 21 of the pogo pins 20 and the fixing strips 33 of the contact terminals 30 are located in the receiving cavity 13 of the insulating housing 10.

As described above, the pogo pins 20 and the corresponding contact terminals 30 are connected with each other by riveting the riveted flanges 21 and the fixing strips 33 together. In use, the pogo pin connector 100 in this invention utilizes the contact portions 322 of the contact terminals 30 to elastically press against a printed circuit board (not shown) so as to realize electrical connection between the pogo pin connector

100 and the printed circuit board. So that omits the reflow soldering in the prior art and effectively avoids deformation and bubble of the insulating housing 10 and the loss of elasticity of the pogo pins 20. It improves the service life of the pogo pin connector 100.

What is claimed is:

1. A pogo pin connector, comprising:

an insulating housing defining a plurality of receiving passageways at a lower part thereof and a plurality of receiving grooves at a top thereof;

a plurality of pogo pins inserted forward in the receiving passageways of the insulating housing, front ends of the pogo pins retractably projecting beyond a front face of the insulating housing, a rear end of each of the pogo pins protruding outward to form a riveted flange; and a plurality of contact terminals assembled forward in the receiving grooves of the insulating housing, each of the contact terminals having a fastening plate placed levelly, an elastic contact arm curvedly extending upward from a front end of the fastening plate to elastically project beyond a top face of the insulating housing, and a fixing strip extending downward from a rear end of the fastening plate with a through hole being opened in a bottom end thereof, the rear ends of the pogo pins passing through the through holes of the contact terminals respectively to make the riveted flanges and the corresponding fixing strips riveted together.

2. The pogo pin connector as claimed in claim 1, wherein the elastic contact arm of the contact terminal includes an elastic arm curved arcuately upward and then extending rearward from the front end of the fastening plate, and a contact portion slantwise extending upward and then bent downward from a free end of the elastic arm, the peak part of the contact portion projects upward beyond the top face of the insulating housing.

3. The pogo pin connector as claimed in claim 2, wherein the receiving passageways are arranged at regular intervals along a transverse direction of the insulating housing and each penetrates through the insulating housing along a front-to-rear direction, the receiving grooves are arranged at regular intervals along the transverse direction of the insulating housing and located over the receiving passageways at a one-to-one correspondence relationship, each of the receiving grooves includes a holding groove penetrating through an upper part of the insulating housing along a front-to-rear direction and an opening formed by a rear of the holding groove extending upward to penetrate through the top of the insulating housing, the fastening plate of the contact terminal is fastened in a bottom side of the holding groove, the elastic arm is inserted in the holding groove and the peak part of the contact portion passes upward through the opening.

4. The pogo pin connector as claimed in claim 1, wherein the riveted flange of the pogo pin is of ring shape and protruded round the rear end of the pogo pin.

5. The pogo pin connector as claimed in claim 1, wherein a rear face of the insulating housing is concaved forward to form a receiving cavity, the rear ends and the riveted flanges of the pogo pins and the fixing strips of the contact terminals are located in the receiving cavity of the insulating housing.

* * * * *